US009378939B2

(12) United States Patent
Blees

(10) Patent No.: US 9,378,939 B2
(45) Date of Patent: Jun. 28, 2016

(54) ELECTRIC LAMP AND MANUFACTURE METHOD THEREFOR

(71) Applicant: KONINKLIJKE PHILIPS N.V., Eindhoven (NL)

(72) Inventor: Martin Hillebrand Blees, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/418,115

(22) PCT Filed: Jul. 30, 2013

(86) PCT No.: PCT/IB2013/056253

§ 371 (c)(1),
(2) Date: Jan. 29, 2015

(87) PCT Pub. No.: WO2014/020536

PCT Pub. Date: Feb. 6, 2014

(65) Prior Publication Data

US 2015/0194297 A1 Jul. 9, 2015

Related U.S. Application Data

(60) Provisional application No. 61/679,112, filed on Aug. 3, 2012.

(51) Int. Cl.

| | |
|---|---|
| ***H01J 17/44*** | (2006.01) |
| ***H01J 61/54*** | (2006.01) |
| ***H01J 61/34*** | (2006.01) |
| ***H01J 9/24*** | (2006.01) |
| ***H01J 61/82*** | (2006.01) |

(52) U.S. Cl.
CPC ..... *H01J 61/547* (2013.01); *H01J 9/247* (2013.01); *H01J 61/34* (2013.01); *H01J 61/54* (2013.01); *H01J 61/827* (2013.01)

(58) Field of Classification Search
CPC ..... H01J 9/323; H01J 61/363; H01J 61/0735; H01J 61/827; H01J 61/366; H01J 9/266; H01J 9/32; H01J 5/32; H01J 5/52; H01J 61/36; H01J 61/34; H01J 61/54; H01J 61/547; H01J 9/247
USPC ..... 313/331, 623, 624, 625, 594; 445/26
See application file for complete search history.

(56) References Cited

U.S. PATENT DOCUMENTS

| | | | | |
|---|---|---|---|---|
| 4,545,799 | A | 10/1985 | Rhodes | |
| 5,424,609 | A * | 6/1995 | Geven et al. | 313/623 |
| 5,426,343 | A | 6/1995 | Rhodes | |

(Continued)

FOREIGN PATENT DOCUMENTS

| | | | |
|---|---|---|---|
| DE | 102010038403 | A1 | 1/2012 |
| JP | 2011023143 | A | 2/2011 |
| JP | 2011154876 | A | 8/2011 |

*Primary Examiner* — Donald Raleigh
*Assistant Examiner* — Kevin Quarterman

(57) ABSTRACT

A high pressure gas discharge lamp includes a ceramic discharge vessel that has a container wall enclosing a discharge space having a filling. First and second electrodes are mutually oppositely arranged in the discharge space and are mounted on first and second feedthroughs, respectively, which extend in a gas-tightly sealed manner through the container wall. The high pressure gas discharge lamp further includes a UV-enhancer that has a wall portion and a chamber. The chamber is enclosed by the wall portion of the UV-enhancer and an end part of the container wall.

14 Claims, 3 Drawing Sheets

(56) References Cited

U.S. PATENT DOCUMENTS

| | | | | |
|---|---|---|---|---|
| 5,811,933 | A | 9/1998 | Van Den Nieuwenhuizen | |
| 7,355,346 | B1 * | 4/2008 | Chen | H01J 61/54 313/234 |
| 7,884,549 | B2 * | 2/2011 | Scholler | H01J 9/266 313/234 |
| 2003/0127985 | A1 * | 7/2003 | Okamoto | H01J 61/547 313/594 |
| 2006/0220558 | A1 * | 10/2006 | Watanabe et al. | 313/623 |
| 2008/0116806 | A1 * | 5/2008 | Van Eysendeyk et al. | 313/623 |
| 2010/0264819 | A1 * | 10/2010 | Chen | H01J 61/54 313/607 |
| 2012/0133279 | A1 * | 5/2012 | Miyazawa et al. | 313/623 |
| 2013/0026914 | A1 * | 1/2013 | Denissen et al. | 315/34 |
| 2014/0175976 | A1 * | 6/2014 | Braun et al. | 313/625 |
| 2014/0320001 | A1 * | 10/2014 | Vries | 313/607 |

* cited by examiner

ELECTRIC LAMP AND MANUFACTURE METHOD THEREFOR

CROSS-REFERENCE TO PRIOR APPLICATIONS

This application is the U.S. National Phase application under 35 U.S.C. §371 of International Application No. PCT/IB2013/056253, filed on Jul. 30, 2013, which claims the benefit of U.S. Provisional Patent Application No. 61/679,112, filed on Aug. 3, 2012. These applications are hereby incorporated by reference herein.

BACKGROUND OF THE INVENTION

The invention relates to a high pressure gas discharge lamp comprising a ceramic discharge vessel having a container wall enclosing a discharge space having a filling, further comprising a first and a second electrode, mutually oppositely arranged in the discharge space and defining a length axis of the discharge vessel, still further comprising a first and a second feedthrough, both extending in a gas-tightly sealed manner through the container wall and on which feedthroughs a respective electrode is mounted, and further comprising a UV-enhancer.

The invention further relates to a method of manufacture of said electric lamp.

A lamp of the type mentioned in the opening paragraph is known from U.S. Pat. No. 5,811,933. The known lamp is a high-pressure discharge lamp, more in particular a metal halide lamp. Such a lamp is suitable for various applications such as general interior lighting, general exterior lighting, video illumination, etc. The discharge vessel of the known lamp is made of ceramic material and is often obtained, via an extrusion process, in a tubular shape and subsequently provided with end plugs/end parts. Alternatively a slip-casting process or an injection molding process is used to manufacture the discharge vessel with end parts. Ceramic material in the present description and claims is understood to be a densely sintered polycrystalline metal oxide such as, for example, $Al_2O_3$ or YAG, and densely sintered polycrystalline metal nitride such as, for example, AlN.

A known problem of this type of lamp is the comparatively wide spread in ignition time. This points to a shortage of free electrons during lamp ignition. The addition of a small quantity of $^{85}Kr$ in the discharge vessel can supplement such a shortage. A disadvantage of this, however, is that $^{85}Kr$ is radioactive. Efforts have been made to avoid this through the use of a UV-enhancer, which is a small UV discharge tube positioned adjacent the discharge vessel and acting as a UV source. The UV-enhancer in the known lamp is formed by a UV-transmitting ceramic tube positioned parallel to and at a distance from the discharge vessel. Upon breakdown, the UV-enhancer will generate said UV-radiation. The influence of this UV-radiation leads to the production of free electrons in the discharge vessel, which in turn strongly promote lamp ignition. Disadvantages of the known lamp are the relatively complicated construction, and the relatively cumbersome manufacture process which, in addition, is relatively expensive.

SUMMARY OF THE INVENTION

It is an object of the invention to provide a lamp in which at least one of the abovementioned disadvantages is counteracted. According to the invention, a lamp of the kind as described in the opening paragraph has a UV-enhancer with a wall portion and a chamber, said chamber being enclosed by the wall portion of the UV-enhancer and an end part of the container wall. It is thus attained that the UV-enhancer is directly adjacent to the discharge vessel, whereby its functioning as a fast and reliable ignition aid is improved. Furthermore, a relatively compact, readily manufacturable lamp is obtained in which the number of components is reduced as, contrary to the known lamp, no complex, separate mounting construction for the UV-enhancer is required and the container wall of the discharge vessel simultaneously functions as a wall of the UV-enhancer. The UV-enhancer has a wall which is made from densely sintered polycrystalline $Al_2O_3$. The fact that this is widely used as a wall material for high-pressure discharge lamps has the major practical advantage that an existing technology for ceramic discharge vessels can be utilized. A very high degree of miniaturization is possible here. Although it was found that a combination of a rare gas and Hg is suitable as a filling, the UV-enhancer preferably has a rare gas filling. A suitable rare gas is inter alia Ne. Ar was found to be particularly suitable as a filling. A pressure (filling pressure) is preferably chosen for the filling which accompanies a minimum breakdown voltage. This filling pressure may be readily ascertained experimentally. A fair approximation can be realized by means of the Paschen curve. A mixture of rare gases in the form of a Penning mixture is also suitable.

An embodiment of the high pressure gas discharge lamp is characterized in that one of the feedthroughs forms an internal electrode of the UV-enhancer, said internal electrode extending through the chamber and extending in a gas-tightly sealed manner through said wall portion. Thus, compared to the known lamp, a further reduction in the number of components is attained, as the separate feedthrough and the internal electrode in the known lamp are combined into one part.

An embodiment of the high pressure gas discharge lamp is characterized in that the UV-enhancer is tubular and concentric with the longitudinal axis extending through the UV-enhancer. This has the advantage that, compared to the known lamp, the manufacture of a rotationally symmetric discharge vessel with UV-enhancer and hence a simpler manufacture process of the lamp is enabled. One way to further simplify the manufacture process is to separate the feedthrough that is (to be) located at the side of the UV-enhancer into a first part sealed in the end part and a second part sealed in the wall portion, the first part in electrically conductive contact with the second part once the lamp is fully assembled. The separation into two parts enables separate, simple, dedicated processing of the sealing parts without the necessity to take precautions to counteract mutual detrimental effects on the sealing quality of the respective dedicated sealing processes. In particular the dedicated process for the manufacture of the discharge vessel comprises shrink-sinter sealing of the discharge vessel under vacuum or Hydrogen atmosphere to at least 98% density to obtain a gastight, relatively clear discharge vessel. The dedicated process for the UV-enhancer comprises a pre-sinter shrink-sealing process to about 60% density under an inert (non-corrosive/oxidative) atmosphere, the wall-portion of the UV-enhancer still having a porous structure, which pores are still accessible for ambient gases. Moreover, said separation into two parts enables an embodiment of the high pressure gas discharge lamp which is characterized in that said electrically conductive contact between the first part and the second part is free from a weld. Such an electrically conductive contact without a weld is obtainable as follows:

the discharge vessel, which has a relatively clear container wall which is fully sintered to at least 98% density, and the UV-enhancer, of which the wall portion is pre-sintered to only about 60% density are assembled together, taking care that the first part of the feedthrough in the discharge vessel and the second part of the feedthrough in the UV-enhancer are such that said first and second part abut or substantially abut each other; subsequently, the combination of fully sintered discharge vessel and pre-sintered UV-enhancer undergo a final sinter step under, for example, an Ar or N2-atmosphere, to fully, i.e. to 98% density, shrink-sinter the UV-enhancer wall-portion onto the container wall.

Said final shrink-sinter step involves four phenomena, i.e.:

the UV-enhancer shrinks in the radial direction, thereby clamping itself in a gastight manner onto the container wall, thus realizing the gastight chamber of the UV-enhancer;

the UV-enhancer shrinks in the axial direction, thereby forcing the first part and the second part of the feedthrough towards each other, thus establishing the electrically conductive contact without a weld;

the chamber of the UV-enhancer is automatically filled with the gas used during the final sinter step, i.e. with Ar or N2; a fill pressure of about 0.15 bar will be obtained inside the chamber when during the final sinter step a gas pressure of about 1 bar is applied;

due to the Ar or N2 gas atmosphere the wall portion of the UV-enhancer becomes opaque as a result of inclusions of the ambient gas during the final sinter step, which gas is trapped inside the wall portion once the final sinter step is completed. Said opaque wall portion reflects the generated UV-radiation towards and into the container wall and into the discharge space during operation of the lamp, thus inducing a fast and reliable ignition of the lamp.

An embodiment of the high pressure gas discharge lamp is characterized in that the first part is made of iridium and the second part is made of niobium. Iridium is directly sealable, i.e. without the need/use of a sealing glass/frit, into the wall of the container, thus providing a seal which is comparatively very resistant to the salt filling inside the discharge vessel. Niobium is well-known to be readily sealable in the wall portion of the UV-enhancer because its coefficient of thermal expansion excellently matches that of alumina.

An embodiment of the high pressure gas discharge lamp is characterized in that the second part comprises niobium wire having a thin-diameter part and a thick-diameter part, for example 250 μm, the niobium wire being sealed in the wall portion with its thick-diameter part. This embodiment is in particular suitable for lamps having a relatively high nominal power, for example lamps having a nominal power of at least 400 W.

An embodiment of the high pressure gas discharge lamp is characterized in that the container wall has an outer container surface and the wall portion has an outer wall surface and in that an active antenna extends over said outer container surface and said outer wall surface. In this embodiment the (electrode of the) UV-enhancer and the active antenna are mutually arranged such that a capacitive coupling between the UV-enhancer and the active antenna is achieved, thus further enabling a fast and reliable ignition of the lamp. A convenient method of providing such an active antenna on the container wall and the wall portion makes use of a printing process of, for example, a Tungsten-containing electrically conductive paste. To simplify the printing process, it is favorable when an embodiment of the high pressure gas discharge lamp is characterized in that the outer container surface is flush with the outer wall surface of the UV-enhancer.

The invention further relates to a method of manufacturing a high pressure gas discharge lamp, comprising the steps of:

manufacturing a sealed discharge vessel by providing its discharge space with a filling and first and second electrodes mounted on a respective first feedthrough part and sealing said first feedthrough parts gas-tightly in a container wall of the discharge vessel;

shrink-sintering a ceramic wall portion of a concave UV-enhancer portion to about 60% density, either simultaneously with sealing a second part of one of the feedthroughs in a ceramic wall of a concave UV-enhancer portion so as to extend therethrough, or prior to a separate sealing step of the second part of the feedthrough in the wall portion of the UV-enhancer portion, using a sealing glass;

assembling the discharge vessel and the UV-enhancer portion such that they both abut against the first feedthrough and the second feedthrough part and subsequently shrink-sintering (at about 1600° C., i.e. 1500-1700° C., and about 1 bar Argon, i.e. 0.4-2 bar Argon) under a chosen gas atmosphere the UV-enhancer part to a density of about 98% and onto the discharge vessel to form the closed wall of the gas-filled UV-enhancer and to establish a fixed electrically conductive contact of the first feedthrough with the second feedthrough part.

This method has the advantage of a relatively simple manufacture process. The separation into two parts enables separate, simple, dedicated processing of the sealing parts without the necessity to take precautions to counteract mutual detrimental effects on the sealing quality of the respective dedicated sealing processes. In particular the dedicated process for the manufacture of the discharge vessel comprises shrink-sinter sealing of the discharge vessel under vacuum or Hydrogen atmosphere to a density at which the sintered container wall material is no longer porous or permeable to gas, for example in that it has at least 90% or 98% density, to obtain a gastight, relatively clear discharge vessel. The dedicated process for the UV-enhancer comprises a pre-sinter shrink sealing process to about 60% density, i.e. 50%-65% density, under an inert (non-corrosive/oxidative) atmosphere, the wall-portion of the UV-enhancer still having a porous structure, which pores are still accessible for ambient gases. Subsequently, the combination of fully sintered discharge vessel and pre-sintered UV-enhancer undergo a final sinter step under a desired gas atmosphere, for example, an Ar or N2-atmosphere, to fully, i.e. to at least 90% or at least 98% density, shrink-sinter the UV-enhancer wall portion onto the container wall. Moreover, as already said hereinabove, said separation into two parts enables an embodiment of the high pressure gas discharge lamp which is characterized in that said electrically conductive contact between the first part and the second part is free from a weld.

Said final shrink sinter step involves three or four phenomena, i.e.:

the UV-enhancer shrinks in the radial direction, thereby clamping itself in a gastight manner onto the container wall, thus realizing the gastight chamber of the UV-enhancer;

the UV-enhancer shrinks in the axial direction, thereby forcing the first part and the second part of the feedthrough towards each other, thus establishing the electrically conductive contact without a weld;

the chamber of the UV-enhancer is automatically filled with the desired gas used during the final sinter step; a fill pressure of about 0.15 bar will be obtained inside the chamber when during the final sinter step a gas pressure of about 1 bar is applied;

in the case that use is made of an Ar and/or N2 gas atmosphere during the final sinter step, due to the Ar or N2 gas atmosphere, the wall portion of the UV-enhancer becomes opaque as a result of inclusions of the ambient gas during the final sinter step, which gas is trapped inside the wall portion once the final sinter step is completed. Said opaque wall portion reflects the generated UV-radiation towards and into the container wall and into the discharge space during operation of the lamp, thus inducing a fast and reliable ignition of the lamp.

BRIEF DESCRIPTION OF THE DRAWINGS

The above and further aspects of the lamp according to the invention will be explained in more detail with reference to a drawing (not true to scale), in which.

DESCRIPTION OF THE PREFERRED EMBODIMENTS

Figure 1:
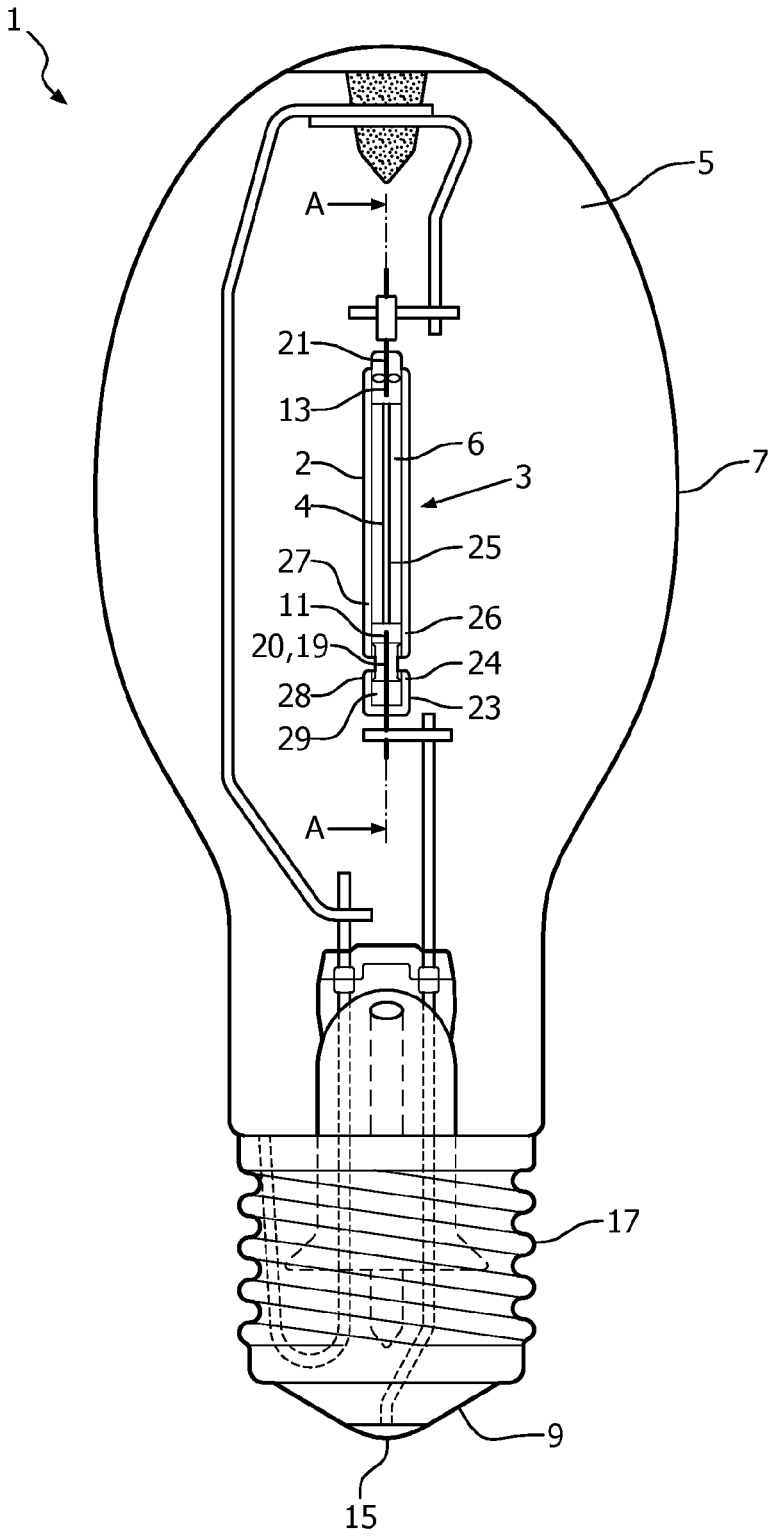
FIG. 1 is a side elevation of a first embodiment of a lamp according to the invention.

FIG. 1 shows a high-pressure metal halide lamp 1 comprising a discharge vessel 3 having a container wall 2 enclosing a discharge space 4 filled with a filling 6, which discharge vessel 3 is surrounded, with an interspace 5, by an outer envelope 7, which supports a lamp cap 9. The discharge vessel 3 is made of densely sintered polycrystalline aluminum oxide and has a first lamp electrode 11 and a second lamp electrode 13, which electrodes are connected to respective contacts 15 and 17 on the lamp cap 4 by means of a respective first 19 and second feedthrough 21, extending over a longitudinal axis A of the discharge vessel 3. The lamp 1 is provided with an UV enhancer 23 having a wall portion 24, said UV-enhancer 23 is situated at an end part 26 of the discharge vessel 3. The UV enhancer 23 has the first feedthrough 19 as an internal enhancer electrode 20. The UV enhancer 23 has a capacitive coupling with an antenna 25 extending over an outer container surface 27 of the container wall 2 and over an outer wall surface 28 of the wall portion 24. The UV-enhancer 23 contains Ar with a filling pressure of 170 mbar in a chamber 29 which is formed by the container wall 2 and the wall portion 24. Preferably, the filling pressure lies between 50 mbar and 300 mbar. At pressure values of less than 50 mbar, the UV output of the enhancer appears to become smaller; at pressure values of more than 300 mbar, the ignition voltage of the enhancer may assume too high values. A combination of mercury and an inert (rare) gas, for example N2, Ne, Ar, Xe, or Kr, is also possible as a filling for the UV enhancer. However, an inert (rare) gas or a mixture of inert (rare) gases is preferred, because this precludes the use of the heavy metal mercury.

A number of lamps having a construction as shown in FIG. 1 were subjected to an ignition test. The lamps are 39 W CDM lamps, make Philips, connected to a supply voltage source of 220 V, 50 Hz via a stabilizer ballast provided with an igniter circuit. These lamps have ceramic discharge vessels with fillings comprising metal halide. The ceramic material of the discharge vessel reaches a temperature between 800° C. and 1000° C. during lamp operation. The UV-enhancer in these lamps is situated as shown in FIG. 1. The lamp electrode is therefore directly irradiated by the UV radiation generated in the UV-enhancer. The ignition circuit comprises a starter, type SN57 (Philips); ignition pulses having a maximum value of about 2 kV and a pulse width of about 8·s are supplied. Prior to the ignition test, the lamps were operated for 10 to 15 minutes and subsequently switched off and maintained in a dark room for at least 1.5 hours. All lamps ignited after an ignition time that was well within the requirement of 30 s. It clearly appeared that there was only a very small ignition delay at relatively low ignition voltage pulses (2 kV). Furthermore, the spread of this ignition delay appeared to be very small.

Figure 2A:
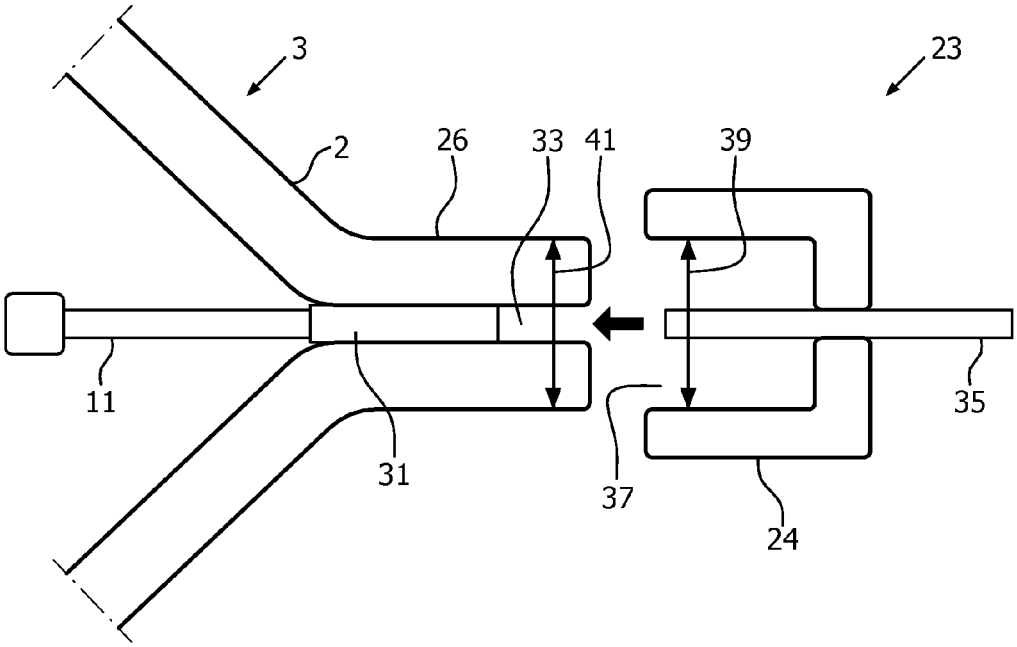
FIGS. 2*a-c* show various stages in the manufacture process of the lamp.
Figure 2B:
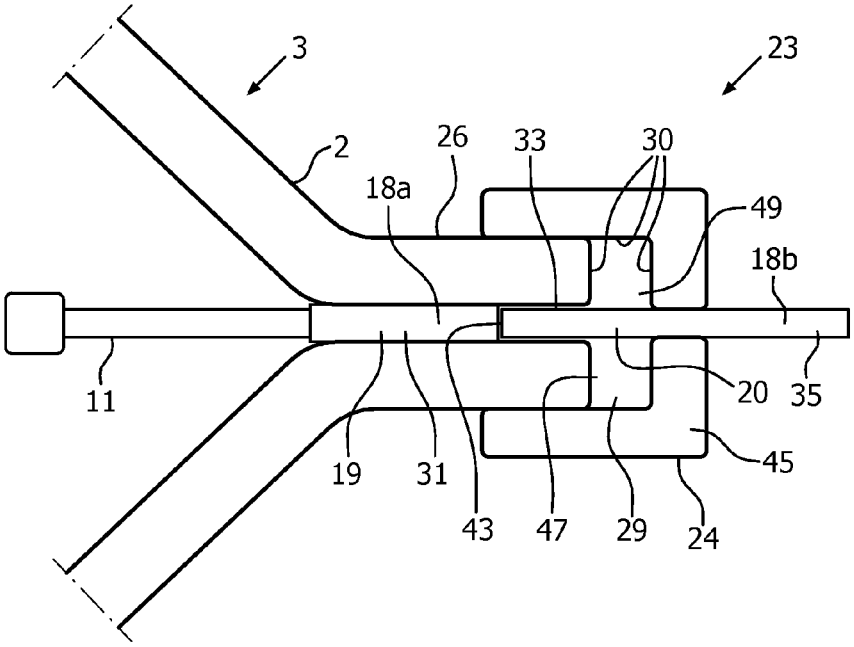
Figure 2C:
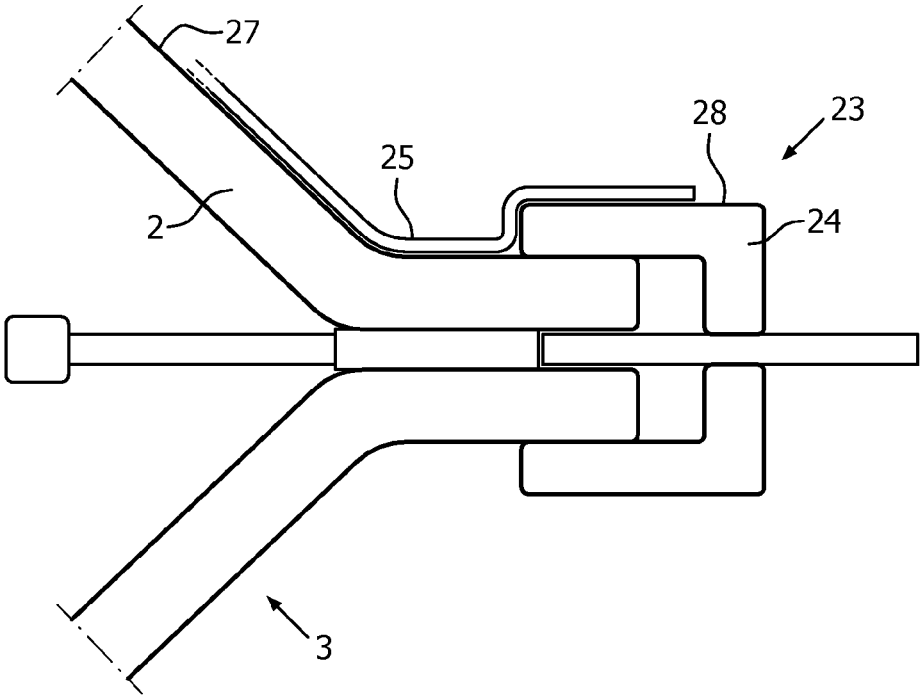

FIGS. 2*a-c* show a UV-enhancer 23 and a discharge vessel 3, which are similar to the ones of FIG. 1, in a cross-sectional view and in greater detail in various stages of the manufacture thereof. In FIG. 2*a*, a first stage of the manufacture is shown in which the discharge vessel 3 and UV-enhancer 23 are in an unassembled configuration. The discharge vessel 3 has a tungsten electrode 11 mounted on an Iridium wire 31 which is fully, gas-tightly embedded in an aperture 33 in an end part 26 of the ceramic container wall 2 via a shrink-sealing process. The end part is made of ceramic material, for example densely sintered polycrystalline aluminum oxide sintered to about 98% density, and it has an outer diameter 41 which essentially will not change during a subsequently applied sinter step. The UV-enhancer 23 has a cylindrical, cup/concave-shaped wall portion 24 through which a Niobium wire 35 extends, the wall portion 24 is made of ceramic material, for example sintered polycrystalline aluminum oxide sintered to about 60% density. The cylindrical, cup-shaped wall portion 24 has an open side 37 and an internal diameter 39 which is just somewhat larger than the outer diameter 41 of the end part 26 of the container wall 2 so that it snugly fits over said end part 26.

In FIG. 2*b*, the discharge vessel 3 and UV-enhancer 23 are in assembled position, i.e. the wall portion 24 of the UV-enhancer 23 is shifted over the container wall 2 and the niobium wire 35 is inserted into the aperture 33 of the end part 26 of the container wall 2 such that it abuts against the embedded Iridium wire 31. Subsequently, the assembled combination is sintered at about 1600° C. under 1 bar Argon atmosphere. The sintering causes, through shrink sealing from 60% density to about 98% density, the wall portion 24 to be gas-tightly sintered onto the end part 26 to form the UV-enhancer chamber 29. Thus, the wall portion 24 of the UV-enhancer 23 together with a part of the container wall 2 forms a closed wall 30 of the UV-enhancer 23 which encloses said chamber 29. Said chamber 29 is filled with the gas atmosphere applied during said sinter step, i.e. with Argon, its pressure being about 150 mbar at room temperature (•20° C.). Furthermore, due to the shrinking of the wall portion 24, the niobium wire 35 is forced towards the Iridium wire 31 to establish a weldless, yet very good, reliable electrically conductive contact 43 therewith. Thus, a feedthrough is formed in which the iridium forms a first feedthrough part 18*a* and the niobium forms a second feedthrough part 18*b*. As initially the wall portion 24 has only 60% density and is porous, i.e. ambient gas can penetrate into the bulk 45 of the material of the wall portion 24, the pores of said wall portion 24 will be filled with ambient gas, i.e. with Argon. Subsequently, during the sinter step, said Argon gas is trapped inside the bulk 45 of the wall portion 24 due to shrinkage of the material of the wall portion 24, resulting in the wall portion 24 becoming opaque and highly reflective. UV-radiation generated in the chamber 29 of the UV-enhancer 23 thus will be "guided" towards the transparent container wall 2 and towards the electrode 11 inside the discharge vessel 3. The UV-enhancer electrode 20 is the feedthrough 19 extending through a first extremity 47 of the chamber 29, at a side where the first lamp electrode 11 is mounted on the feedthrough, and said feedthrough extending through a second extremity 49 of the chamber 29 where the UV-enhancer 23 is sealed in a vacuum-tight manner by means of a sintered plug. Said plug forms the end part 26 of the container wall 2, through which the feedthrough 19 extends and is connected to a current conductor (which in turn is connected to an electrical contact, see FIG. 1). The UV-enhancer 23 has a length of 13 mm, an external diameter of 1.5 mm and an internal diameter of 0.675 mm.

In FIG. 2*c*, the final stage of the manufacture of the discharge vessel 3+UV-enhancer 23 is shown in that an antenna 25 is provided which extends on an outer surface 27 of the container wall 2 and on an outer surface 28 of the wall portion 24 of the UV-enhancer 23. The antenna 25 may be formed from an electrically conductive material such as transparent conductive coatings such as, for example ITO (indium Tin Oxide), or from metal coatings, for example, tungsten that is deposited upon the outer surfaces 27,28 after the discharge vessel 3 and UV-enhancer 23 have been joined and sintered.

Figure 3:
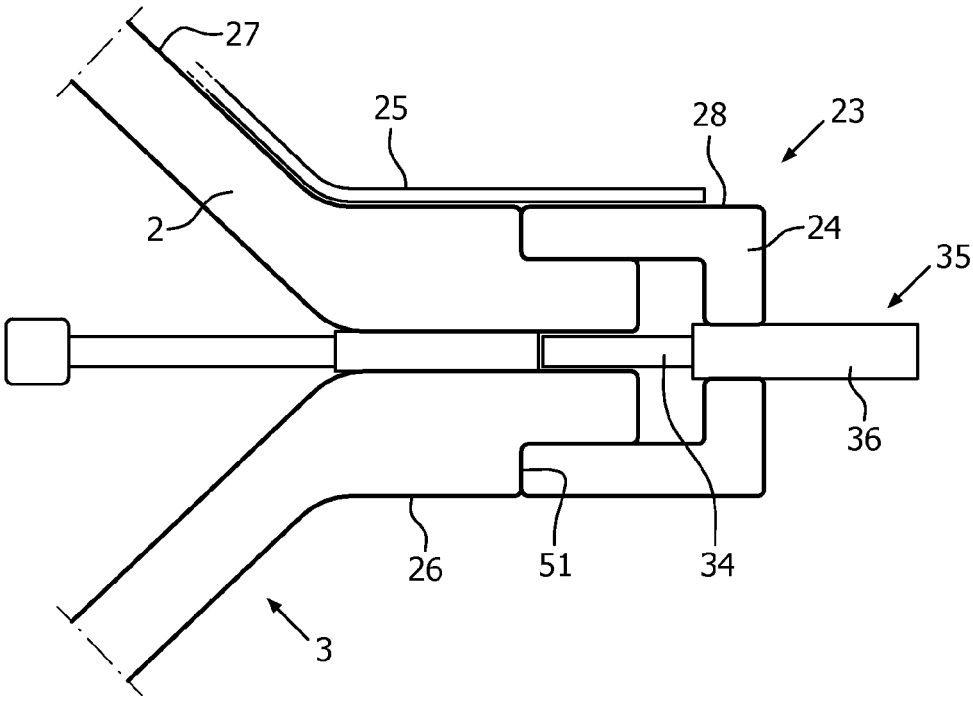
FIG. 3 shows a second embodiment of the lamp according to the invention.

FIG. 3 shows the assembled UV enhancer 23 and the discharge vessel 3, which are similar to the ones of FIG. 1 and FIG. 2*c*, in a cross-sectional view and in greater detail. The end part 26 of the container wall 2 of the discharge vessel 3 has a stepped profile 51 such that said profile and the wall portion 24 of the UV-enhancer 23 fit together in such a manner that the outer surfaces 27,28 of the container wall 2 and the wall portion 24 are flush after being shrink-sintered together. Thus, it is enabled to easily provide an antenna 25 on said outer surfaces 27,28. Furthermore, the niobium wire 35 has a thin diameter part 34 and a thick diameter part 36. The niobium wire 35 is sealed in the wall portion 24 with its thick diameter part 36. Such a construction is especially suitable for electric lamps having a relatively high nominal power, for example a nominal power of 400 W or more.

The invention claimed is:

1. A high pressure gas discharge lamp comprising:

a ceramic discharge vessel comprising a container wall enclosing a discharge space having a filling;

a first electrode and a second electrode, mutually oppositely arranged in the discharge space and defining a longitudinal axis of the discharge vessel;

a first feedthrough and a second feedthrough, both extending in a gas-tightly sealed manner through the container wall; wherein the first and second electrodes are mounted on the first and second feedthroughs, respectively; and a UV-enhancer comprising a wall portion and a chamber, said chamber being enclosed by the wall portion of the UV-enhancer and an end part of the container wall of the discharge vessel, wherein the wall portion of the UV enhancer overlaps the end part of the container wall such that an inner surface of the wall portion of the UV enhancer fits over an outer surface of the end of the container wall.

2. The high pressure gas discharge lamp as claimed in claim 1, wherein one of the first and second feedthroughs forms an internal electrode of the UV-enhancer, said internal electrode extending through the chamber and extending in a gas-tightly sealed manner through said wall portion.

3. The high pressure gas discharge lamp as claimed in claim 1, wherein the UV-enhancer is configured to be tubular and concentric with the longitudinal axis of the discharge vessel extending through the UV-enhancer.

4. The high pressure gas discharge lamp as claimed in claim 1, wherein at least one of the first and second feedthroughs comprises a first part sealed in the end part of the container wall and a second part sealed in the wall portion of the UV-enhancer, the first part having an electrically conductive contact with the second part.

5. The high pressure gas discharge lamp as claimed in claim 4, wherein said electrically conductive contact between the first part and the second part is free from a weld.

6. The high pressure gas discharge lamp as claimed in claim 4, wherein the first part is made of iridium and the second part is made of niobium.

7. The high pressure gas discharge lamp as claimed in claim 4, wherein the second part comprises a niobium wire having a thin diameter part and a thick diameter part, the thick diameter part of the niobium wire being sealed in the wall portion of the UV-enhancer, and wherein the thin diameter part is thinner than the thick diameter part.

8. The high pressure gas discharge lamp as claimed in claim 1, wherein the container wall has an outer container surface and the wall portion of the UV-enhancer has an outer wall surface, and wherein an active antenna is configured to extend over said outer container surface and said outer wall surface.

9. The high pressure gas discharge lamp as claimed in claim 8, wherein the outer container surface is configured to be flush with the outer wall surface of the UV-enhancer.

10. A method of manufacturing a high pressure gas discharge lamp, comprising acts of:

manufacturing a sealed discharge vessel comprising a discharge space, the discharge space being provided with a filling and first and second electrodes mounted on a respective first and second feedthrough parts, and sealing said first and second feedthrough parts gas-tightly in a container wall of the sealed discharge vessel;

shrink sintering a ceramic wall portion of a concave UV-enhancer portion to about a 60% density, either simultaneously with sealing a part of one of the first and second feedthroughs in the ceramic wall portion of the concave UV-enhancer portion so as to extend therethrough, or prior to a separate sealing of the part of one of the first and second feedthroughs in the ceramic wall portion of the concave UV-enhancer portion, using a sealing glass; and assembling the sealed discharge vessel and the concave UV-enhancer portion to abut the first feedthrough and the second feedthrough against each other, and subsequently shrink-sintering under a predetermined gas atmosphere the concave UV-enhancer portion to a density of about 98% and onto the sealed discharge vessel to form a closed wall of the concave UV-enhancer portion filled with gas and to establish an electrically conductive contact of the first feedthrough with the second feedthrough.

11. The high pressure gas discharge lamp as claimed in claim 1, wherein the UV enhancer is configured to have a cylindrical, cup-shaped wall portion.

12. A gas discharge lamp comprising:

a discharge vessel comprising a container wall enclosing a discharge space having a filling;

a first electrode and a second electrode, mutually oppositely arranged in the discharge space;

a first feedthrough and a second feedthrough, both extending in a gas-tightly sealed manner through the container wall, wherein the first and second electrode are mounted on the first and second feedthrough, respectively; and a UV-enhancer comprising a wall portion and a chamber, said chamber being enclosed by the wall portion of the UV-enhancer and an end part of the container wall of the discharge vessel, wherein the wall portion of the UV enhancer overlaps the end part of the container wall such that an inner surface of the wall portion of the UV enhancer fits over an outer surface of the end part of the container wall.

13. The gas discharge lamp of claim 12, wherein an outer diameter of the wall portion of the UV enhancer is larger than an outer diameter of the end part of the container wall.

14. The gas discharge lamp of claim 12, wherein the end part of the container wall includes a first end portion having a first diameter and a second end portion having a second diameter which is smaller than the first diameter, and wherein an outer diameter of the wall portion of the UV enhancer is equal to the first diameter.

* * * * *